US007290784B2

(12) United States Patent
Heil et al.

(10) Patent No.: US 7,290,784 B2
(45) Date of Patent: Nov. 6, 2007

(54) SNOW GLIDE BOARD

(75) Inventors: Tobias Heil, Mitterfels (DE); Andreas Ametsbichler, Straubing (DE)

(73) Assignee: Marker Volkl International GmbH, Baar (CH)

( * ) Notice: Subject to any disclaimer, the term of this patent is extended or adjusted under 35 U.S.C. 154(b) by 119 days.

(21) Appl. No.: 11/171,203

(22) Filed: Jul. 1, 2005

(65) Prior Publication Data

US 2006/0001237 A1 Jan. 5, 2006

(30) Foreign Application Priority Data

Jul. 2, 2004 (DE) ..... 10 2004 032 386

(51) Int. Cl.
*A63C 5/07* (2006.01)

(52) U.S. Cl. ..... 280/617; 280/609

(58) Field of Classification Search ..... 280/611, 280/617, 618, 608, 609, 620, 11.15, 602, 280/607, 11.14
See application file for complete search history.

(56) References Cited

U.S. PATENT DOCUMENTS 4,008,901 A * 2/1977 Conn ..... 280/7.13
5,035,443 A * 7/1991 Kincheloe ..... 280/618
5,505,478 A * 4/1996 Napoliello ..... 280/618
5,520,405 A * 5/1996 Bourke ..... 280/613
5,813,689 A * 9/1998 Mansure ..... 280/607
5,871,223 A * 2/1999 Zanco ..... 280/607
5,915,719 A * 6/1999 Bauvois ..... 280/607
6,217,055 B1 * 4/2001 Silva ..... 280/607
6,257,613 B1 * 7/2001 Porte ..... 280/617
6,557,866 B2 * 5/2003 Jones et al. ..... 280/14.22
2002/0113413 A1 * 8/2002 Sosin et al. ..... 280/618

FOREIGN PATENT DOCUMENTS

EP 0 383 104 B1 11/1993

* cited by examiner

*Primary Examiner*—Christopher P. Ellis
*Assistant Examiner*—Brian Swenson
(74) *Attorney, Agent, or Firm*—Hoffman, Wasson & Gitler

(57) ABSTRACT

The invention relates to a new type of snow glide board, in particular a ski, with at least one binding, which is held on one snow glide board top side by locking sections interlocking behind undercuts on the snow glide board body, wherein open insertion apertures are provided on the top of the snow glide board for inserting the locking sections into the undercuts, each of which apertures pass into one undercut.

33 Claims, 5 Drawing Sheets

SNOW GLIDE BOARD

BACKGROUND OF THE INVENTION

The invention relates to a Snow glide board, in particular a ski, with at least one binding, which is held on one snow glide board body top side by locking sections interlocking behind or engaging undercuts on the snow glide board body, wherein insert apertures are provided on the top of the snow glide board for inserting the locking sections in the undercuts, each of which apertures passes into one undercut and are preferably open on or towards the top of the snow glide board.

A snow glide board in the form of a ski, in which the binding is fastened to the top of the ski body with a bayonet-type latching device is known in the art (EP 0 383 104 B1). This latching device is achieved, in particular by an open groove in both longitudinal sides of the ski body, or in the side walls there, and by binding plates with a C-shaped cross section or C-shaped Profile that positively lock with its bent ends behind the ski body in the area of this groove. In order to enable the insertion of the bent ends of the respective C-profile into the grooves, the side walls are provided with additional recesses, by which the grooves are open laterally toward the top of the ski body, so that each binding plate can be locked onto the ski body in the manner of a bayonet by placing it on the ski body and then sliding it longitudinally.

Although this known ski enables the easy fastening and/or replacement of the binding, the known construction has a number of disadvantages, e.g. because the binding plates bearing the binding elements necessarily extend over the longitudinal sides of the ski body, and also because the grooves in the side wall result in weakening of the ski body, and therefore the strength of the anchoring of the binding to the ski body is limited due to the relatively low height of the side walls and due to the material normally used for side walls.

It is an object of the present invention is to provide for a snow glide board that retains the basic advantages of a bayonet-type fastening of the binding of binding elements while enabling a construction that is not detrimental to the running characteristics of the snow glide board.

SUMMARY OF THE INVENTION

This object is achieved by a snow glide board, in particular a ski, with at least one binding, which is held on one snow glide board body top side by locking sections interlocking behind or engaging undercuts on the snow glide board body, wherein insert apertures are provided on the top of the snow glide board for inserting the locking sections in the undercuts, each of which apertures passes into one undercut, an wherein the undercuts are formed by connecting elements anchored on the snow glide board top.

BRIEF DESCRIPTION OF THE DRAWINGS

The invention is described below based on an exemplary embodiment with reference to the drawings, in which.

DETAILED DESCRIPTION OF THE INVENTION

Figure 1:
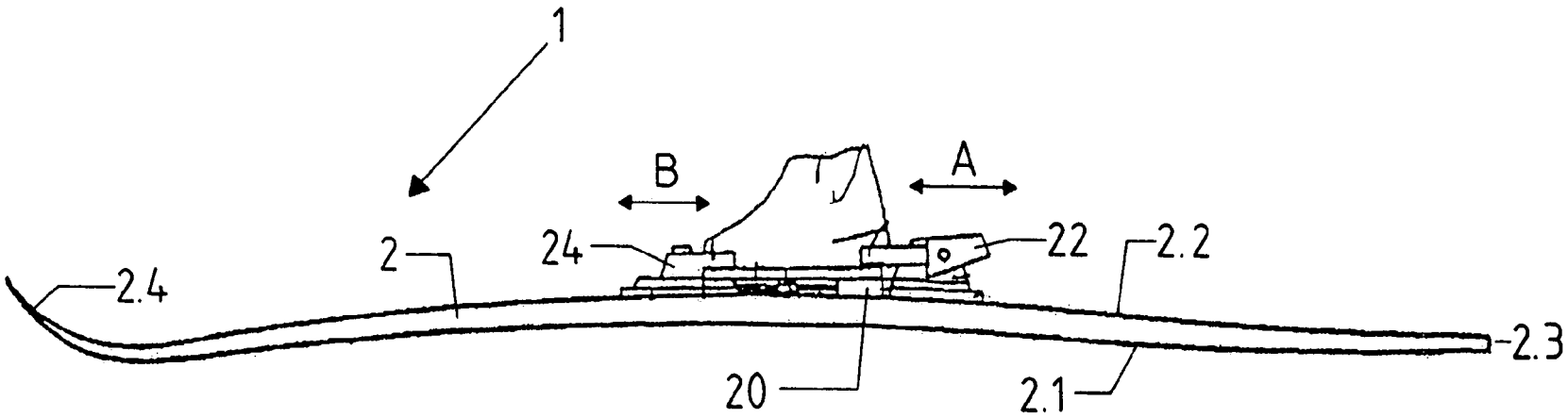
FIG. 1 shows a simplified representation in side view of a snow glide board according to the invention in the form of a ski.
Figure 2:
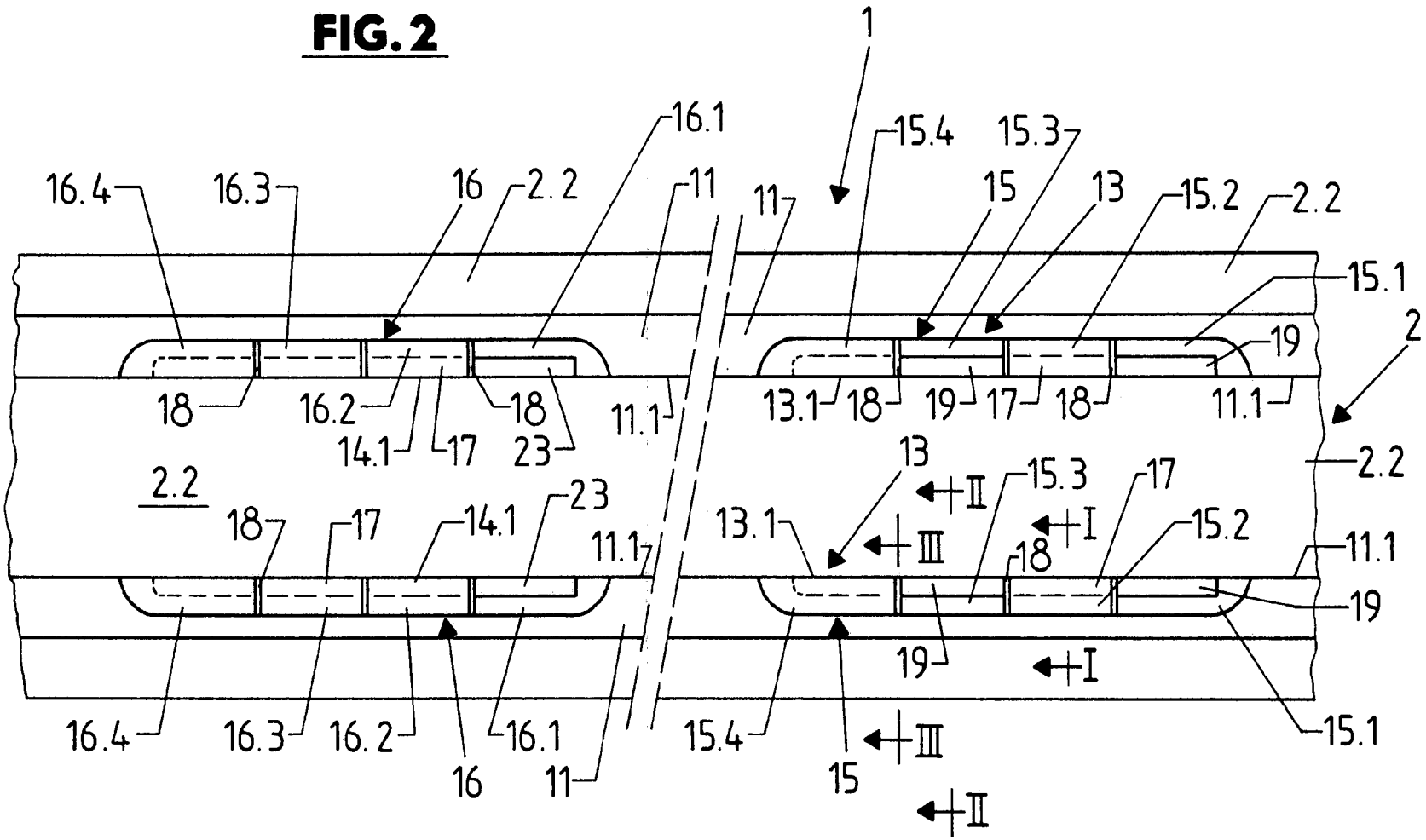
FIG. 2 shows an enlarged partial representation in top view of the ski of FIG. 1.
Figure 3:
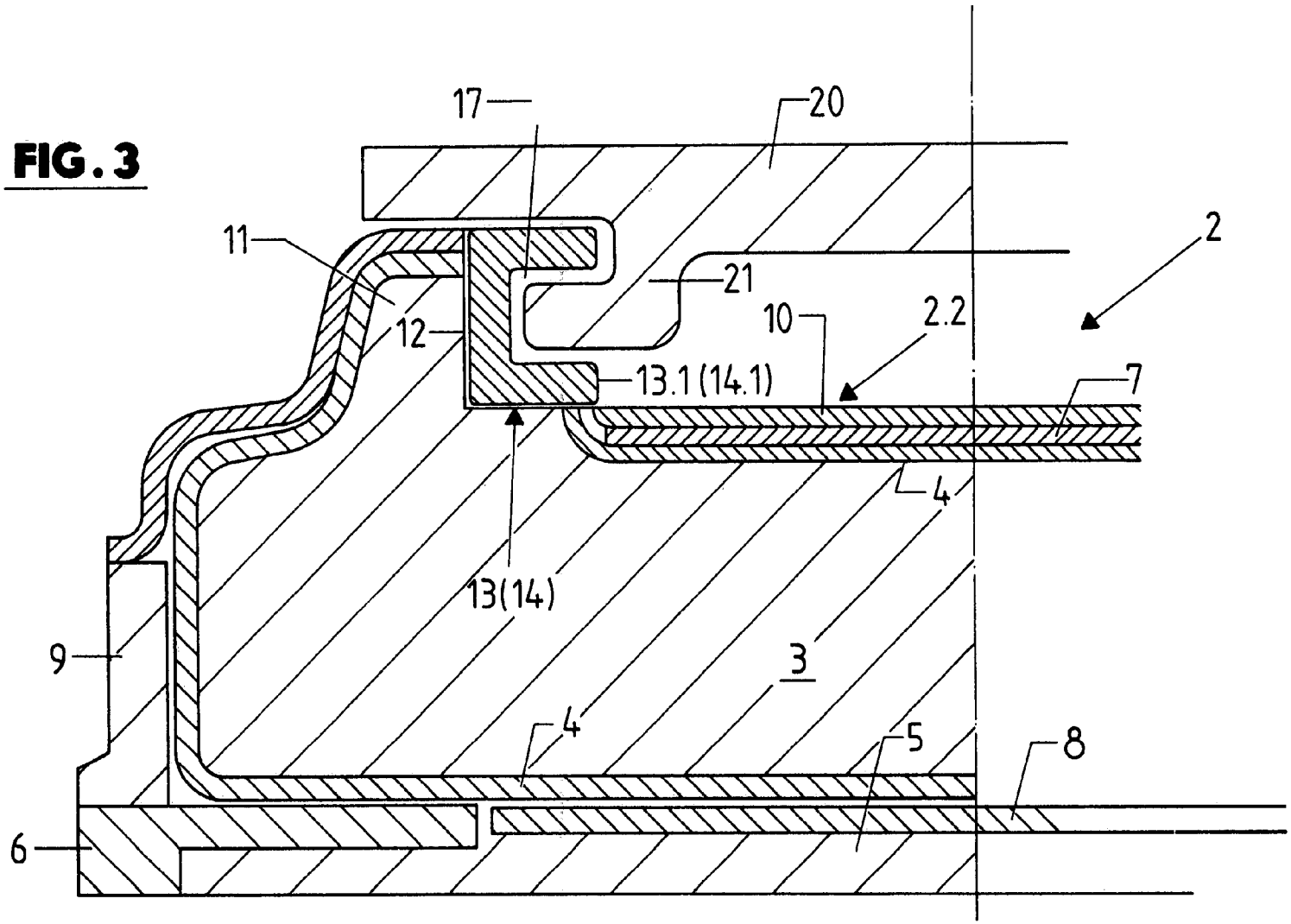
FIG. 3-5 show cross sections corresponding to the lines I-I, II-II and III-III of FIG. 1.
Figure 4:
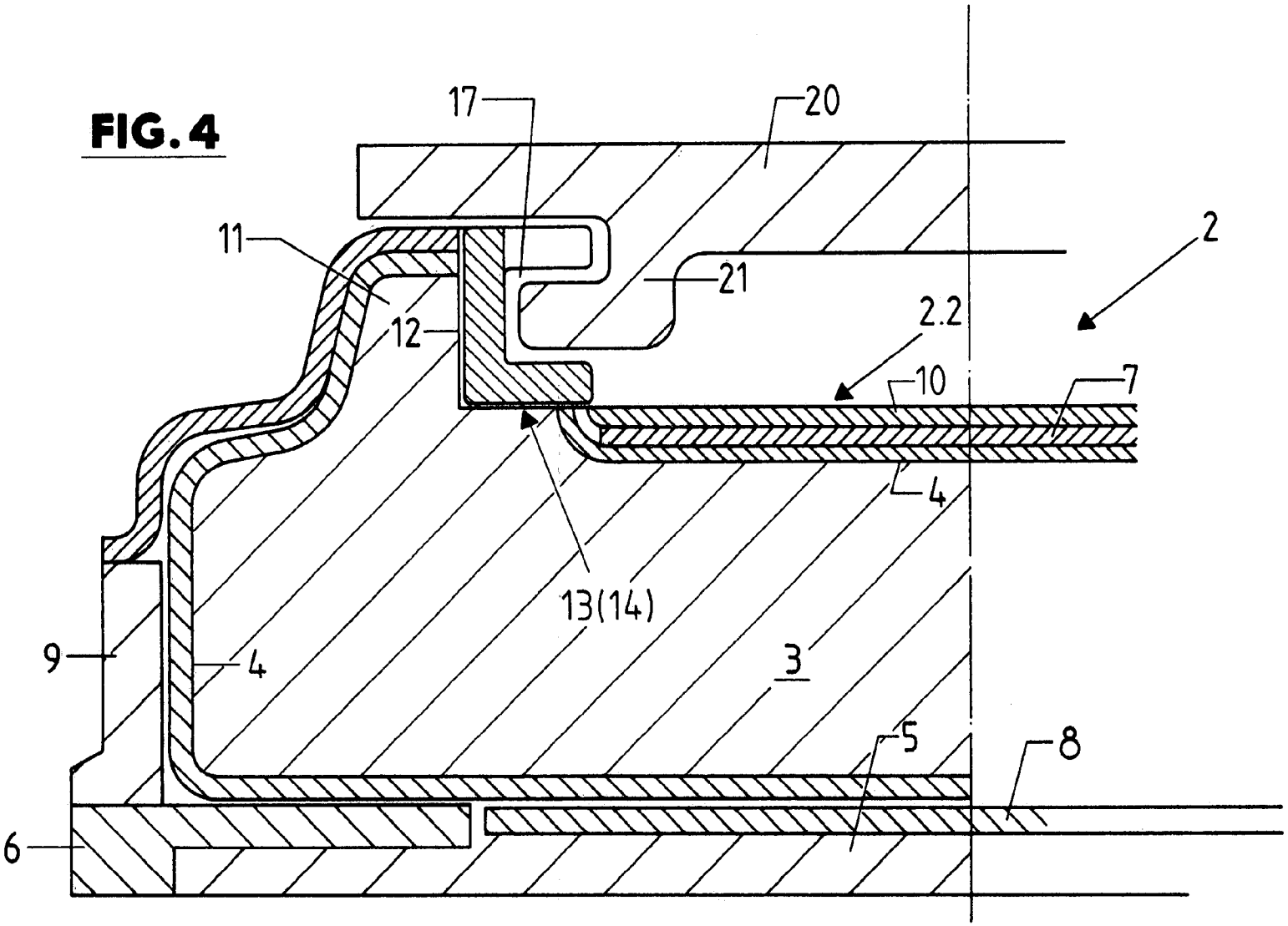
Figure 5:
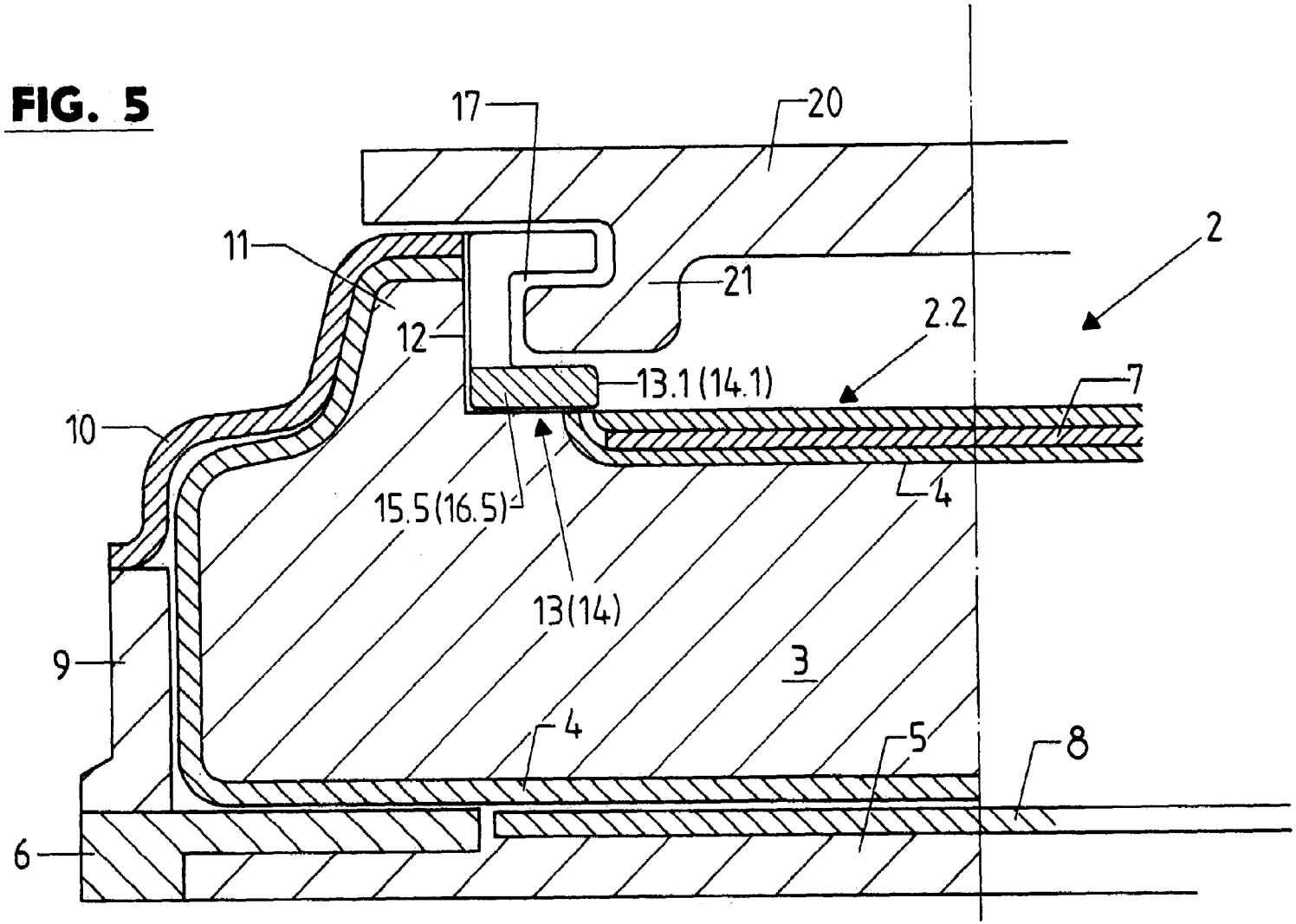

In the drawings, 1 generally designates a ski body 2, which is designed using the conventional ski construction materials and essentially in the conventional manner. Accordingly, the ski body 2 consists for example of the inner core 3 with a torsion box 4 for example made of a fiber reinforced plastic material and surrounding said core, of the running surface coating 5 with the lateral steel edges 6 forming the ski body bottom 2.1, of the upper reinforcing layer or belt 7 above the core 3 and the lower reinforcing layer or belt 8 between the torsion box and the running surface coating 5, of the side walls 9 forming the longitudinal sides of the ski and of a decorative surface foil 10 forming the top and also partially the longitudinal sides of the ski body 2.

In the depicted embodiment, the core 3, the torsion box 4 and e.g. also the upper belt 7 are formed so that the ski body 2 forms on the ski body top 2.2 two projections 11 that both extend parallel to each other and at a distance from each other in the longitudinal direction of the ski body, for example over a great part of length of the ski body or over the entire or nearly the entire length of the ski body. On the inner sides 11.1 of the projections 11, which sides face one another, connecting elements 13 and 14 are inserted into recesses 12, which are located in the central area of the ski body 2 and in the binding area and which are open toward the other corresponding projection and toward the top of the ski 1. On each projection in one direction from the rear end 2.3 of the ski body 2 toward the shovel area 2.2 of said ski body, first the connecting element 13 and then the other connecting element 14 is provided in the longitudinal direction of the ski body at a distance from the first connecting element 13.

The connecting elements 13 and 14 in the depicted embodiment are essentially strip-shaped shaped bodies 15 and 16 extending in ski longitudinal direction and made of metal and/or plastic. These shaped bodies are each designed with one groove 17 that is open on one connecting element longitudinal side 13.1 or 14.1 and that is however closed on both ends of the respective connecting element 13 or 14 and are fastened in the recesses 12 in a suitable manner, for example by screws and/or by molded pegs and/or by means of gluing, etc., so that the two connecting elements 13 are located directly opposite of each other perpendicular to the longitudinal extension of the ski with the open side of their grooves 17 in pairs, as are the two connecting elements 14.

In order that the connecting elements 13 and 14, which are flush on their top side with the top side of the respective projection, do not neither protrude over the top side of the respective projection or ski body, nor impair the flexibility of the ski body 2, they are segmented, i.e. they are provided with groove-shaped notches 18 extending perpendicular to their longitudinal extension so that each connecting element 13 and 14 and the corresponding shaped body 15 and 16 forms a total of four segments 15.1-15.4 and 16.1-16.4. These segments are connected only by means of material sections 15.5 and 16.5, which, when the connecting pieces are mounted, are located on the lower limit of the respective recess 12 facing the bottom of the ski body 2.1.

In the depicted embodiment the connecting elements 13 and 14 and their shaped bodies 15 and 16 are both of the same length. Furthermore, each shaped body is divided by the notches 18 into four segments of the same length.

On the top of the connecting element 13 or on the top of the segments 15.1 and 15.3 each connecting element 13 is provided with an aperture 19, which in the depicted embodiment extends over the entire length of the respective segment, from the edge of the groove 17 to the bottom of this groove. By means of the recesses 19, locking sections 21 provided on the bottom of one binding element, for example on the bottom of one binding plate 20, can each be inserted into one groove 17 of the connecting element 13 by placing it on top, for which the length of the locking element 21 in the longitudinal direction of the binding plate 20 or the longitudinal direction of the ski is equal to or slightly less than the corresponding length of the recesses 19. By moving the binding plate 20 in the longitudinal direction of the ski by the length of one segment 15.1-15.4, the binding plate 20 can be anchored with its locking elements 21 on the two connecting elements 13 and therefore on the top of the ski body 2.2. In the depicted embodiment, the binding plate 20 comprises two pairs of strip-shaped locking elements 21 on its bottom side.

The distance between the locking elements 21 on each longitudinal side of the binding plate 20 is then likewise equal to the distance between the recesses on the connecting elements 13. In the depicted embodiment the locking sections 21 are formed by corresponding profiling of the binding plates. The rear end of the binding plate 20 is therefore anchored doubly on each connecting element 13, i.e. by means of double overlapping. In fastened state, the binding plate 20 lies with its two longitudinal edges on the top of the projections 11 and on the top of the connecting elements 13 and 14, so that the support of the binding plate 20 on the ski body 2 is far outward for optimum transfer of force between the binding and the ski.

In the area of the rear end of the binding plate 20 the rear binding element 22 can be adjusted in the longitudinal direction of the ski, as indicated by the double arrow.

The connecting elements 14 and the corresponding shaped parts 16 each have a recess 23 corresponding to the recess 19 on the first segment 16.1 in the axis direction "ski body end 2.3-shovel 2.4". The remaining segments 16.2-16.4 connecting in the direction of the front of the ski and in the direction of the shovel area 2.4 are not provided with the recess 23. The front binding element 24 (binding toe piece) is fastened to the front end of the binding plate 20 so that it can be adjusted in the longitudinal direction of the binding plate 20 (double arrow B). The binding element 24 is designed on its bottom side corresponding to the binding plate 20, with one locking section 21 on each longitudinal side. With these connecting sections 21, the binding element 24 connected with the binding plate 20 can be inserted via the recesses 23 into the groove 17 of the front connecting element 14 and locked into position there through axial movement of the binding plate 20. Since the connecting elements 14 comprise a plurality, i.e. in the depicted embodiment a total of three segments 16.2-16.4 without the recess 23 and arranged consecutively in the longitudinal direction of the connecting element, after locking of the binding element 24 and therefore also of the front end of the binding plate 20 to the connecting elements 14 and to the ski body 2, a longitudinal adjustment (double arrow B) of the binding element 24 relative to the binding plate 20 is possible while remaining locked to the ski body 2. The embodiment preferably enables the insertion of the locking sections 21 on the binding plate 20 and on the front binding element 22 into the corresponding recesses 19 and 23 when the front binding element 24 is in one of the two end positions of its adjustment (double arrow B) relative to the binding plate 20, i.e. in the depicted embodiment in the end position in which the binding element 22 is nearest the base plate 20.

After insertion of the locking sections 21 of the binding plate 20 and of the binding element 24 through the recesses 19 and 23 into the groove 17 of the connecting elements 13 and 14 and after locking by longitudinal sliding, this locking of the sections 21 or of the binding plate 20 is secured by suitable means, for example by fixing the binding plate 20 to the ski body 2 by means of a pin, etc.

The invention was described above based on an exemplary embodiment. It goes without saying that modifications and variations are possible, without abandoning the underlying inventive idea upon which the invention is based.

REFERENCE LIST

1 ski
2 ski body
2.1 bottom of ski body
2.2 top of ski body
2.3 rear end of ski body
2.4 shovel area
3 core
4 torsion box
5 running surface coating
6 steel edge
7 upper belt
8 lower belt
9 side wall
10 surface foil
11 projection
12 recess
13, 14 connecting or locking element
15, 16 body of locking element
15.1, 15.4 segment
16.1-16.4 segment
15.5-16.5 material section
17 locking groove
18 groove-shaped notch
19 recess
20 binding plate
21 locking section
22 rear binding element (binding insert)
23 recess
24 front binding element (binding insert)
A, B adjustment possibility

What is claimed is:

1. A snow glide board having at least one binding held on a top side of the snow glide board body by locking sections interlocking or engaging behind undercuts on the snow glide board body, wherein insert apertures are provided on the top side of the snow glide board for inserting the locking sections in the undercuts, each of which said apertures passes into one undercut, and wherein the undercuts are formed by connecting elements anchored on the snow glide board top and wherein the snow glide board body comprises on the top side, at least in a binding area, two projections at a distance from each other, the two projections extending in a longitudinal direction of the snow glide board and that the connecting elements are located in recesses of the projections.

2. The snow glide board according to claim 1, wherein the connecting elements are located on mutually facing or opposing sides of the projections.

3. The snow glide board according to claim 1, wherein the connecting elements are each formed from a shaped part or connecting element body, which comprises the undercut and at least one insertion aperture.

4. The snow glide board according to one claim 1, wherein one rear binding element or one plate bearing thereon binding element comprises at least two pairs of locking sections, and that the corresponding connecting elements each comprise two insertion apertures.

5. The snow glide board according to claim 1, wherein the connecting elements are located in one axis direction perpendicular to their longitudinal extension opposing each other in pairs.

6. The snow glide board according to claim 1, wherein the locking sections are located on the binding or binding elements in pairs.

7. The snow glide board according to claim 1, wherein each undercut is formed by at least one groove in the connecting element in one shaped body forming the connecting piece.

8. The snow glide board according to claim 1, wherein at least one connecting element or the shaped body forming said connecting element is segmented longitudinally, so that the respective shaped body comprises a plurality of segments connected with each other via material sections.

9. The snow glide board according to claim 1, wherein the binding or binding elements are supported on a top of the connecting elements or the projections comprising these connecting elements.

10. The snow glide board according to claim 1, wherein the connecting elements are made of metal, plastic or a combination thereof.

11. The snow glide board according to claim 1, wherein the connecting elements are held onto the snow glide board body by means of fastening elements, screws, molded pegs, by means of gluing, or combinations thereof.

12. The snow glide board according to claim 1, wherein the connecting elements form support surfaces for the binding or its elements.

13. A snow glide board having at least one binding held on a top side of the snow glide board body by locking sections interlocking or engaging behind undercuts on the snow glide board body, wherein insert apertures are provided on the top side of the snow glide board for inserting the locking sections in the undercuts, each of which said apertures passes into one undercut, wherein the undercuts are formed by connecting elements anchored on the snow glide board top, and wherein the connecting elements are located in one axis direction perpendicular to their longitudinal extension opposing each other in pairs.

14. A snow glide board having at least one binding held on a top side of the snow glide board body by locking sections interlocking or engaging behind undercuts on the snow glide board body, wherein insert apertures are provided on the top side of the snow glide board for inserting the locking sections in the undercuts, each of which said apertures passes into one undercut, wherein the undercuts are formed by connecting elements anchored on the snow glide board top, and wherein at least one connecting element or the shaped body forming said connecting element is segmented longitudinally, so that the respective shaped body comprises a plurality of segments connected with each other via material sections.

15. The snow glide board according to claim 13, wherein the snow glide board body comprises on the top side, at least in a binding area, two projections at a distance from each other, the two projections extending in a longitudinal direction of the snow glide board and that the connecting elements are located in recesses of the projections.

16. The snow glide board according to claim 15, wherein the connecting elements are located on mutually facing or opposing sides of the projections.

17. The snow glide board according to claim 13, wherein the connecting elements are each formed from a shaped part or connecting element body, which comprises the undercut and at least one insertion aperture.

18. The snow glide board according to one claim 13, wherein one rear binding element or one plate bearing thereon binding element comprises at least two pairs of locking sections, and that the corresponding connecting elements each comprise two insertion apertures.

19. The snow glide board according to claim 13, wherein the locking sections are located on the binding or binding elements in pairs.

20. The snow glide board according to claim 13, wherein each undercut is formed by at least one groove in the connecting element in one shaped body forming the connecting piece.

21. The snow glide board according to claim 13, wherein at least one connecting element or the shaped body forming said connecting element is segmented longitudinally, so that the respective shaped body comprises a plurality of segments connected with each other via material sections.

22. The snow glide board according to claim 13, wherein the binding or binding elements are supported on a top of the connecting elements or the projections comprising these connecting elements.

23. The snow glide board according to claim 13, wherein the snow glide board body comprises on the top side, at least in a binding area, two projections at a distance from each other, the two projections extending in a longitudinal direction of the snow glide board and that the connecting elements are located in recesses of the projections.

24. The snow glide board according to claim 14, wherein the connecting elements are located on mutually facing or opposing sides of the projections.

25. The snow glide board according to claim 14, wherein the connecting elements are each formed from a shaped part or connecting element body, which comprises the undercut and at least one insertion aperture.

26. The snow glide board according to one claim 14, wherein one rear binding element or one plate bearing thereon binding element comprises at least two pairs of locking sections, and that the corresponding connecting elements each comprise two insertion apertures.

27. The snow glide board according to claim 14, wherein the connecting elements are located in one axis direction perpendicular to their longitudinal extension opposing each other in pairs.

28. The snow glide board according to claim 14, wherein the locking sections are located on the binding or binding elements in pairs.

29. The snow glide board according to claim 14, wherein each undercut is formed by at least one groove in the connecting element in one shaped body forming the connecting piece.

30. The snow glide board according to claim 14, wherein the binding or binding elements are supported on a top of the connecting elements or the projections comprising these connecting elements.

31. The snow glide board according to claim 14, wherein the connecting elements are made of metal, plastic or a combination thereof.

32. The snow glide board according to claim 14, wherein the connecting elements are held onto the snow glide board body by means of fastening elements, screws, molded pegs, by means of gluing, or combinations thereof.

33. The snow glide board according to claim 14, wherein the connecting elements form support surfaces for the binding or its elements.

* * * * *